US008863663B2

(12) United States Patent
Schwitzky

(10) Patent No.: US 8,863,663 B2
(45) Date of Patent: Oct. 21, 2014

(54) METHOD FOR CONTROLLING THE ORIENTATION AND/OR POSITION OF SHEETS PROCESSED ON A PRINTING MACHINE

(75) Inventor: Volkmar Rolf Schwitzky, Würzburg (DE)

(73) Assignee: KBA-Notasys SA, Lausanne (CH)

( * ) Notice: Subject to any disclaimer, the term of this patent is extended or adjusted under 35 U.S.C. 154(b) by 1933 days.

(21) Appl. No.: 11/720,148

(22) PCT Filed: Nov. 24, 2005

(86) PCT No.: PCT/IB2005/003532

§ 371 (c)(1),
(2), (4) Date: May 24, 2007

(87) PCT Pub. No.: WO2006/056865

PCT Pub. Date: Jun. 1, 2006

(65) Prior Publication Data

US 2008/0006163 A1 Jan. 10, 2008

(30) Foreign Application Priority Data

Nov. 25, 2004 (EP) ..... 04028064

(51) Int. Cl.

| | |
|---|---|
| ***B41F 1/34*** | (2006.01) |
| ***B65H 9/00*** | (2006.01) |
| ***D21H 21/40*** | (2006.01) |

(52) U.S. Cl.

CPC ..... *B65H 9/00* (2013.01); *D21H 21/40* (2013.01); *B65H 2301/5111* (2013.01); *B65H 2511/20* (2013.01); *B65H 2511/216* (2013.01); *B65H 2511/242* (2013.01); *B65H 2511/512* (2013.01); *B65H 2511/5125* (2013.01); *B65H 2511/516* (2013.01); *B65H 2511/52* (2013.01)

USPC ..... 101/485; 101/487; 101/488

(58) Field of Classification Search

USPC ..... 399/366; 283/82, 86, 58, 59; 101/485, 101/DIG. 46

See application file for complete search history.

(56) References Cited

U.S. PATENT DOCUMENTS

| | | | |
|---|---|---|---|
| 4,165,465 | A | 8/1979 | Kanatani et al. |
| 4,879,000 | A | 11/1989 | Gausa |

(Continued)

FOREIGN PATENT DOCUMENTS

| | | | | |
|---|---|---|---|---|
| EP | 0 406 157 | A1 | | 1/1991 |
| EP | 0 949 069 | A1 | | 10/1999 |
| EP | 1 364 809 | A1 | | 11/2003 |
| GB | 956145 | | | 4/1964 |
| GB | 2400076 | A | * | 10/2004 |
| JP | 2001270086 | | | 10/2001 |
| WO | 2004050991 | A1 | | 6/2004 |

OTHER PUBLICATIONS

"Check Orientation Detection for Automatic Teller Machine," IBM Technical Disclosure Bulletin, IBM Corp. New York, vol. 30, No. 1, Jun. 1, 1987 pp. 16-17.

*Primary Examiner* — Matthew G Marini

(74) *Attorney, Agent, or Firm* — Seager, Tufte & Wickhem LLC

(57) ABSTRACT

There is described a method for controlling the orientation and/or position of sheets (1) processed on a printing machine, each sheet being provided with at least one marking (12; 15) embedded in the sheet, which marking is embedded in the sheet during manufacturing thereof, prior to processing of the sheet on a printing machine. The marking (12; 15) is disposed in a selected location of the sheet and defines a unique orientation and/or position of the sheet. The method comprises the steps of: —checking for the presence or absence of the marking at the selected location on the sheet and/or of characteristic features of the said marking; and —issuing a warning signal if the marking is not detected at the selected location or if the characteristic features of the marking are not detected at the said selected location. The invention advantageously makes use of features already embedded in the sheets (such as metallic and/or magnetic strips or threads, watermarks, etc.) as control markings for controlling the orientation and/or position of the sheets.

14 Claims, 2 Drawing Sheets

(56) References Cited

U.S. PATENT DOCUMENTS

| | | | | |
|---|---|---|---|---|
| 5,062,359 | A | 11/1991 | Giori | |
| 5,199,744 | A * | 4/1993 | Shenton | 283/91 |
| 5,449,200 | A | 9/1995 | Andric et al. | |
| 6,101,939 | A | 8/2000 | Giori et al. | |
| 6,601,507 | B1 | 8/2003 | Mallok | |
| 2003/0104176 | A1 | 6/2003 | Schwenk | |
| 2004/0003253 | A1 * | 1/2004 | Ogino et al. | 713/176 |

* cited by examiner

METHOD FOR CONTROLLING THE ORIENTATION AND/OR POSITION OF SHEETS PROCESSED ON A PRINTING MACHINE

TECHNICAL FIELD

The present invention concerns a method for controlling the orientation and/or position of sheets processed on a printing machine such as sheets used in the production of securities, banknotes, passports, ID and other similar security documents.

BACKGROUND OF THE INVENTION

When printing sheets, such as paper sheets, in printing machines for securities and other similar security documents, it has to be avoided that sheets which are transferred from one machine to another machine are put in said other machine on the wrong side or wrongly orientated. Indeed, not all the printing operations are carried out in the same machine, therefore it happens that printed sheets are transferred from one machine to another or are even taken out of a machine in case of a problem in said machine. For this reason, it has to be ensured that printed sheets are always in a definite and known position with respect to the printing machine with their reference side properly aligned with the machine reference for the successive printings made on the sheet to be in register on the same side of the paper and also recto-verso.

Therefore, even if the sheets are transported manually or displaced by other means, one has to be sure that when introduced in a machine, they are in the proper position. If not, the machine must be stopped or the sheet in improper position must not be printed to avoid loss of paper sheets.

It is already known to apply printed markings onto the sheets, in particular in a non-printed area of the sheets (such as the margin or spaces between prints on the sheet), which markings are then read by appropriate reading units (see for instance U.S. Pat. No. 4,165,465 or U.S. Pat. No. 6,601,507).

Alternatively, it is known to provide the sheets with notches, cut-outs or embossed areas which are detected by appropriate detection means (see for instance U.S. Pat. No. 5,196,868 or GB 956 145).

Both solutions however require additional pre-processing of the sheets on the printing machines in order for the control markings to be applied thereon, such pre-processing being necessarily performed at the input of the first printing machine where the sheets are first processed. This accordingly implies hardware resources as well as the use of consumables for performing application of the control markings.

Further, the control markings must be applied in non-printed areas of the sheets (such as in the margins or between columns or rows of prints) if the control markings are not to interfere with the prints. This accordingly limits the possibilities to control the orientation and/or position of the sheets as well as the ability to dispose the necessary marking and reading stations on the printing machine.

SUMMARY OF THE INVENTION

An aim of the invention is to improve the known means for detection of the position of a sheet.

Another aim is to avoid improperly printed sheets by an early detection of the position of the sheet being printed.

It is a further aim of the present invention to provide simple means allowing a check of the position of the sheet to be printed.

Another aim of the present invention is to provide an effective control means.

To this effect, the invention complies with the definition of the claims.

Generally speaking, the proposed method comprises the steps of:

- feeding sheets in the printing machine, which sheets are each already provided with at least one marking embedded in the sheet during manufacturing thereof, prior to processing of the sheet on the printing machine, the marking being disposed in a selected location of the sheet and defining a unique orientation and/or position of the sheet;
- checking for the presence or absence of the marking at the selected location on the sheet and/or of characteristic features of the marking (including the shape of the marking or any physical property of the marking per se such as metallic or magnetic properties, reflectivity or transparency, etc.); and
- issuing a warning signal if the marking is not detected at the selected location or if the characteristic features of the marking are not detected at the selected location.

An idea of the present invention is to exploit the presence of features already embedded in the sheets to be printed as markings for controlling the orientation and/or position of the sheets before processing thereof on a printing press. By "marking embedded in the sheet", one should understand, within the scope of the present invention, a marking which is embedded in the sheet during manufacturing thereof, prior to processing of the sheet on a printing machine, i.e. a marking that is intimately embedded and integrated in the sheet per se and which is as such applied or created during manufacturing of the sheets. One feature the marking should exhibit in order for the control of the position and/or orientation of the sheet to be performed is that the marking should be such that it defines a unique orientation and/or position of the sheet. In other words, the marking must exhibit some sort of asymmetry in its shape, in its location on the sheet, or in any of its spatial and/or physical properties.

BRIEF DESCRIPTION OF THE DRAWINGS

The invention will be best understood by the description of exemplary embodiments and with reference to the drawings in which.

EMBODIMENTS OF THE INVENTION

Figure 1:
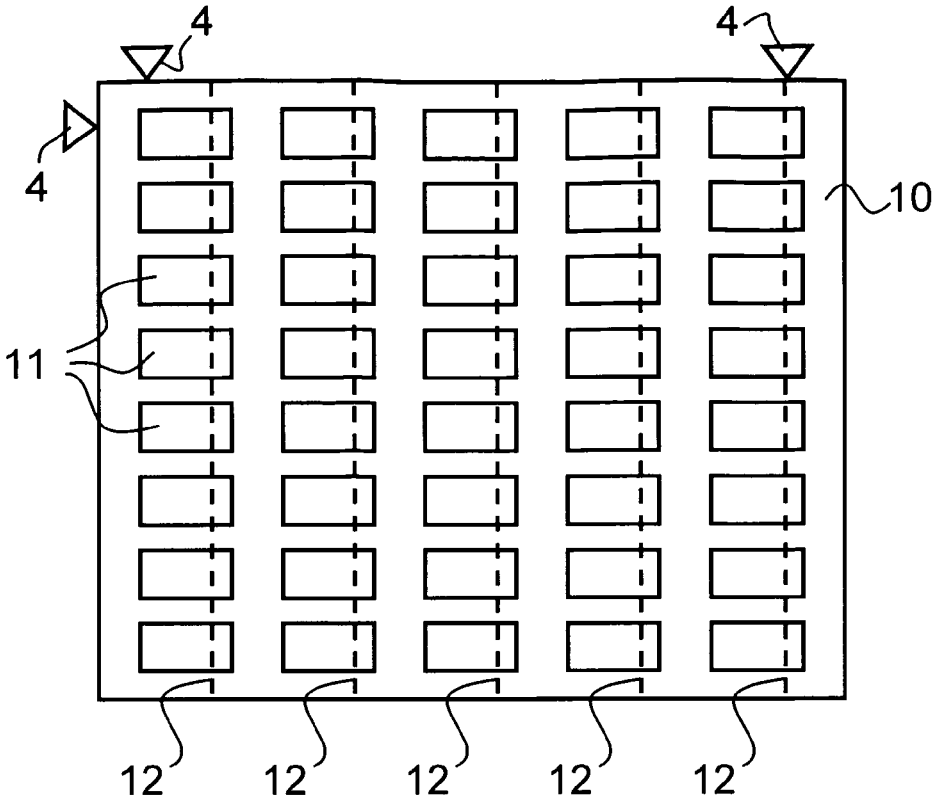
FIG. 1 schematically shows an exemplary sheet used in the production of banknotes comprising a plurality of metallic and/or magnetic strips or threads embedded parallel to one another in the sheet.

As shown schematically in FIG. 1, a sheet 10 used in the production of security documents, in particular banknotes, is typically provided with a matrix-like arrangement of prints 11, here an array of five columns per eight rows of prints, each corresponding to a particular security document to be printed. At the time of the manufacturing, the sheet 10 was provided in this case with five parallel strips or threads 12 extending along each column of prints 11. Such strips or threads 12 are typically metallic and/or magnetic strips of material directly embedded in the sheet at the time of the manufacturing. Such strips 12 can be fully or partly embedded in the sheets and be additionally provided with visible markings one side of the strips such as a particular name/symbol or a given monetary value or invisible markings, such as a magnetically inscribed code or symbol. In this case, a unique orientation and position of the sheet is defined by the location of the strips 12 on the sheet, and possibly by the markings provided on the strips 12. A single detector might be provided along the path of any one of the five strips 12 in order to control for the presence or absence of the strip and therefore provide an indication as to whether the sheets are appropriately oriented and/or positioned. Alternately or additionally, a detector might be used to sense the visible or invisible marking provided on the strips 12. It goes without saying that it suffice that the detector used be capable of checking for the presence or absence of the feature to be inspected, or at most a signature thereof.

In the machine, the sheet 10 is aligned with reference markings or stops 4 which align the sheet before the printing operation in order to provide a reference position for each sheet and ensure a proper positioning when entering the machine. This is usually performed at the feeding location of the printing machine by front stops against which a leading edge of the sheet is aligned and at least one lateral stop against which a lateral edge of the sheet is aligned so that the sheet is precisely positioned before printing, thereby ensuring a proper register of the sheets.

Once the sheet 10 is in position, it is then possible with simple reading means, for example optical means, to check on an incoming sheet 10 whether the marking 12 can be detected or not. If the marking 12 is not present at the expected position, this can mean either that the sheet is wrongly orientated, or that is it turned upside down (wrongly orientated or not), or even that the sheet should not be printed because it has a defect.

During the entire printing process, i.e. throughout the processing of the sheets in successive printing machines, the presence of the marking 12 can be systematically checked before each printing operation to confirm the proper positioning of the sheet being fed in the printing machine.

Figure 2:
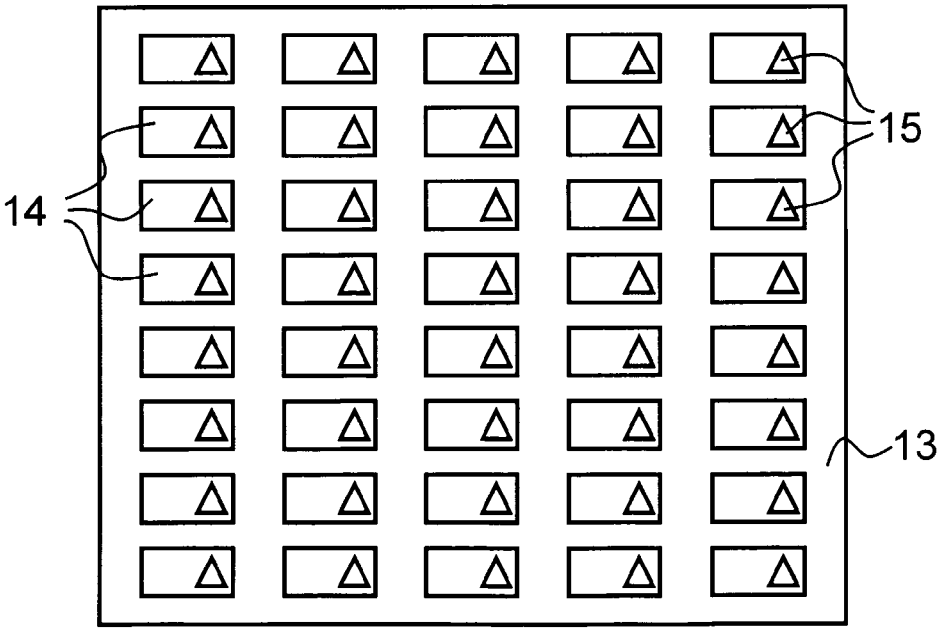
FIG. 2 schematically shows another exemplary sheet used in the production of banknotes comprising a plurality of watermarks embedded in the sheet, the watermarks being disposed in a matrix-like arrangement.
Figure 3:
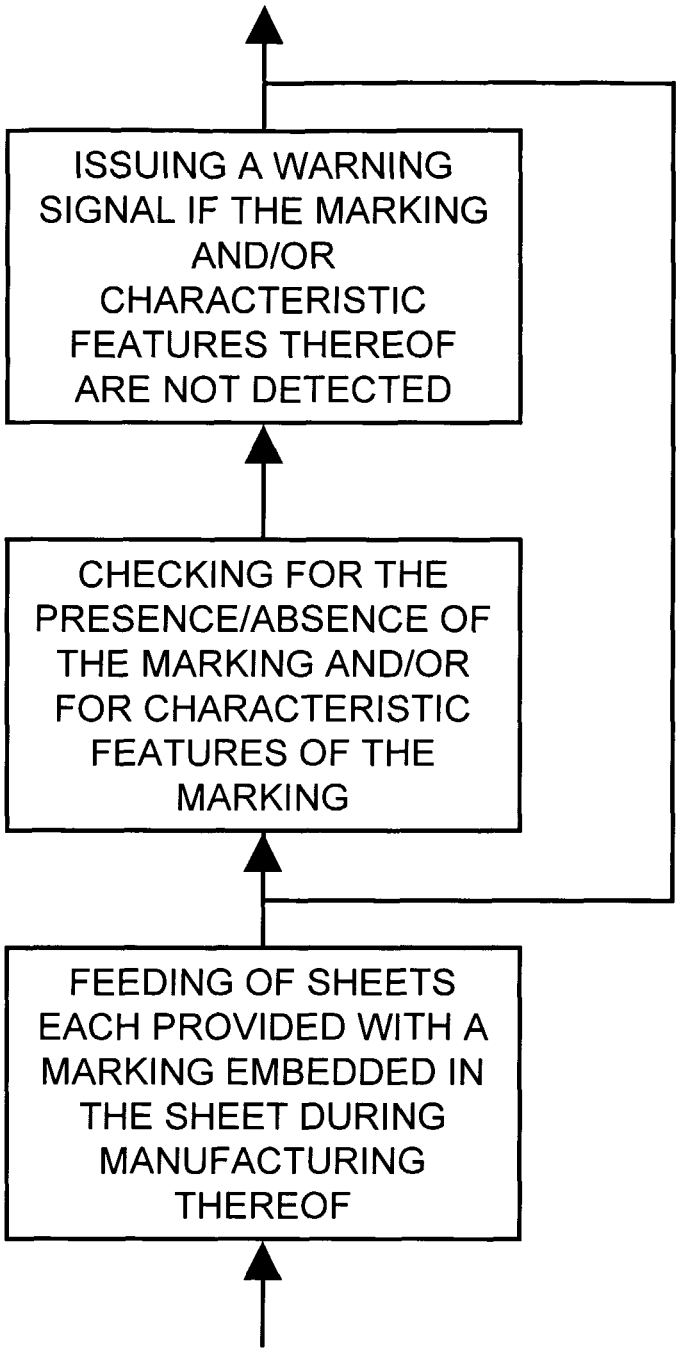
FIG. 3 is a schematic block diagram of the method according to the invention.

FIG. 2 schematically shows another embodiment of a sheet 13 which may be used in the production of security documents which will receive prints 14 in a matrix-like arrangement. In the representation of FIG. 2, the marking used for the purpose of controlling the orientation and/or position of the sheet 13 is a watermark 15, which has a shape of a triangle for the purpose of illustration. Of course other shapes of watermark could be envisaged to fulfil the aim of the invention. Such watermark could for instance be a portrait or any other symbols embedded in the sheets at the time of the manufacturing thereof.

In the example of FIG. 2, each print 14 is provided with its own watermark 15. The location of the watermarks 15 on the sheet again defines a unique orientation and/or position of the sheet and may be exploited as a control marking. Additionally, the shape of the watermarks 15 as such defines a unique orientation and/or position of the sheet due to its asymmetrical shape. Any asymmetrical shape might be envisaged.

The detection of the markings can be made with suitable optical detection means, either in the visible or invisible spectrum. Alternatively, in the case of markings having metallic or magnetic properties, as the metallic and/or magnetic strips illustrated in FIG. 1, the physical properties of the markings per se could be checked, for instance by a suitable magnetic detector.

As an alternative to the security threads and watermarks mentioned in connection with FIGS. 1 and 2, one may use as control markings, any other marking embedded in the sheets at the time of the manufacturing thereof. For instance, it is now known to incorporate in the sheets so-called OVD's (i.e. optically variable devices such as holograms) at the time of the manufacturing of the sheets. The presence or absence of such OVD's and/or of characteristic features of such OVD's (shape, reflectivity, optical microstructure, etc.) may again be exploited within the scope of the present invention for the purpose of controlling the orientation and/or position of the sheets.

Similarly, it is also known to provide sheets with semi- or fully-transparent windowed regions. In this case again, the windowed regions might be exploited for the purpose of controlling the orientation and/or position of the sheets. In this latter example, a simple illumination device for illuminating the windowed region and suitable photo-receiver disposed on the other side of the sheets might be used to detect the passage of such windowed regions and thereby provide an indication as to whether or not the sheets are appropriately positioned.

On a more general level, the sheets will be processed sequentially on a plurality of successive printing machines and the checking of the control marking and the issuance of the warning signal will be performed on each of the successive printing machines, preferably before the printing operation starts on said printing machine (i.e. at the feeding location).

In that context, processing of sheets for the productions of banknotes, or of similar security documents, typically includes subjecting the sheets to offset printing on an offset printing press (typically a printing press for simultaneous recto-verso printing as for instance disclosed in EP 0 949 069), to intaglio printing on an intaglio printing press (as for instance disclosed in EP 0 406 157) and to numbering on a numbering press (as for instance disclosed in EP 1 364 809). The sheets may be processed further on other printing or processing machines, such as foil-stamping machines for applying foils or patches on the sheets, screen printing machines for printing elements by serigraphy, varnishing machines for applying varnish or lacquer on the sheets, as well as finishing equipment, in particular for cutting the sheets into individual securities and collecting and packing the securities into bundles and packs.

It will be understood that various modifications and/or improvements obvious to the person skilled in the art can be made to the embodiments described hereinabove without departing from the scope of the invention defined by the annexed claims.

The invention claimed is:

1. A method for processing sheets on printing machines, the method comprising the steps of:

providing a printing machine having a detector for controlling orientation and/or position of the sheets;

providing a sheet suitable for use in the production of banknotes or security documents, said sheet being provided with at least one marking embedded in the sheet, which marking is embedded in the sheet during manufacturing thereof, prior to processing of the sheet on the printing machine, the marking being disposed in a selected location of the sheet and defining a unique orientation and/or position of the sheet;

feeding the sheet into the printing machine;

using the detector to check for the presence or absence of the marking at the selected location on the sheet and/or of characteristic features of the marking;

issuing a warning signal if the marking is not detected at the selected location or if the characteristic features of the marking are not detected at the selected location; and printing the sheet using the printing machine if no warning signal is issued.

2. The method according to claim 1, wherein the marking is a metallic and/or magnetic strip or thread embedded in the sheet.

3. The method according to claim 2, wherein each sheet comprises a plurality of metallic and/or magnetic strips embedded parallel to one another in the sheet.

4. The method according to claim 1, wherein the marking is a watermark embedded in the sheet.

5. The method according to claim 4, wherein each sheet comprises a plurality of watermarks embedded in the sheet, the watermarks being disposed in a matrix-like arrangement.

6. The method according to claim 5, wherein the location of the marking on the sheet defines a unique position and orientation of the sheet.

7. The method according to claim 1, wherein the marking has an asymmetrical shape defining a unique position and orientation of the sheet.

8. The method according to claim 7, further comprising the step of printing a matrix-like arrangement of prints onto the sheets and wherein the marking is provided for each of the prints.

9. The method according to claim 1, further comprising the step of printing a matrix-like arrangement of prints onto the sheets and wherein the marking is provided for each of the prints.

10. The method according to claim 1, wherein the sheets are processed sequentially in a plurality of successive printing machines and wherein the checking of the marking and the issuance of the warning signal are performed on each of the successive printing machines.

11. The method according to claim 10, wherein the plurality of successive printing machines includes at least an offset printing machine for performing offset printing of the sheets, an intaglio printing machine for performing intaglio printing of the sheets and a numbering machine for numbering the sheets.

12. A method for controlling orientation and/or position of a sheet during processing thereof on a printing machine, comprising the steps of:

providing a sheet suitable for use in the production of securities, said sheet being provided with a marking embedded in the sheet during manufacturing thereof, prior to processing of the sheet on the printing machine; and using the marking to control the orientation and/or position of the sheet during processing on the printing machine.

13. The method according to claim 12, wherein the marking is a metallic and/or magnetic strip or thread embedded in the sheet.

14. The method according to claim 12, wherein the marking is a watermark embedded in the sheet.

* * * * *